United States Patent [19]

Fireman

[11] Patent Number: 4,733,775

[45] Date of Patent: Mar. 29, 1988

[54] TRANSPARENT RECTANGULAR PACKAGING OF SWIM GOGGLES AND THE LIKE

[75] Inventor: Barry R. Fireman, Sharon, Mass.

[73] Assignee: Aqua Leisure Industries Inc., Avon, Mass.

[21] Appl. No.: 883,323

[22] Filed: Jul. 8, 1986

[51] Int. Cl.[4] ..... A45C 11/04

[52] U.S. Cl. ..... 206/5; 206/45.14; 206/523; 229/112; 229/153

[58] Field of Search ..... 206/5, 45.14, 45.34, 206/560, 523, 6, 591, 593; 229/112, 149, 151, 153, 141, 156

[56] References Cited

U.S. PATENT DOCUMENTS

| | | | |
|---|---|---|---|
| 2,381,067 | 8/1945 | Lowey | 229/151 |
| 2,913,100 | 11/1959 | Carmichael | 206/5 R |
| 3,101,843 | 8/1963 | Thompson | 206/5 |
| 3,294,229 | 12/1966 | McConnell et al. | 206/45.33 |
| 3,381,806 | 5/1968 | McDonagh | 206/5 R |
| 3,841,548 | 10/1974 | Curley | 229/112 |
| 3,963,165 | 6/1976 | Hughes | 229/153 |
| 3,977,516 | 8/1976 | Tilue | 206/5 |
| 4,005,815 | 2/1977 | Nerenberg et al. | 229/153 |
| 4,113,096 | 9/1978 | Scott | 206/523 |
| 4,153,091 | 5/1979 | Jahn | 206/523 |
| 4,230,729 | 10/1980 | Hoelzel, Jr. | 229/153 |
| 4,524,868 | 6/1985 | Buckley et al. | 206/523 |

*Primary Examiner*—Stephen Marcus
*Assistant Examiner*—David T. Fidei
*Attorney, Agent, or Firm*—Kane, Dalsimer, Kane, Sullivan and Kurucz

[57] ABSTRACT

A display package for swim goggles and the like comprises a transparent plastic container with a support therein for holding the goggles to be displayed. The support includes a generally trapezoidal foamed plastic insert and the straps of the goggles fit around the sides and back of the support to secure the goggles against the front thereof. The visible parts of the support may contain indicia identifying and/or describing the article displayed. The support has a front panel which is slanted rearwardly and its bottom extends forwardly to the bottom of the container on which the bottom of the goggles can rest. Owing to its construction, the package is substantially pilferproof in view of the time that it would take to remove the goggles from the package and the support.

12 Claims, 11 Drawing Figures

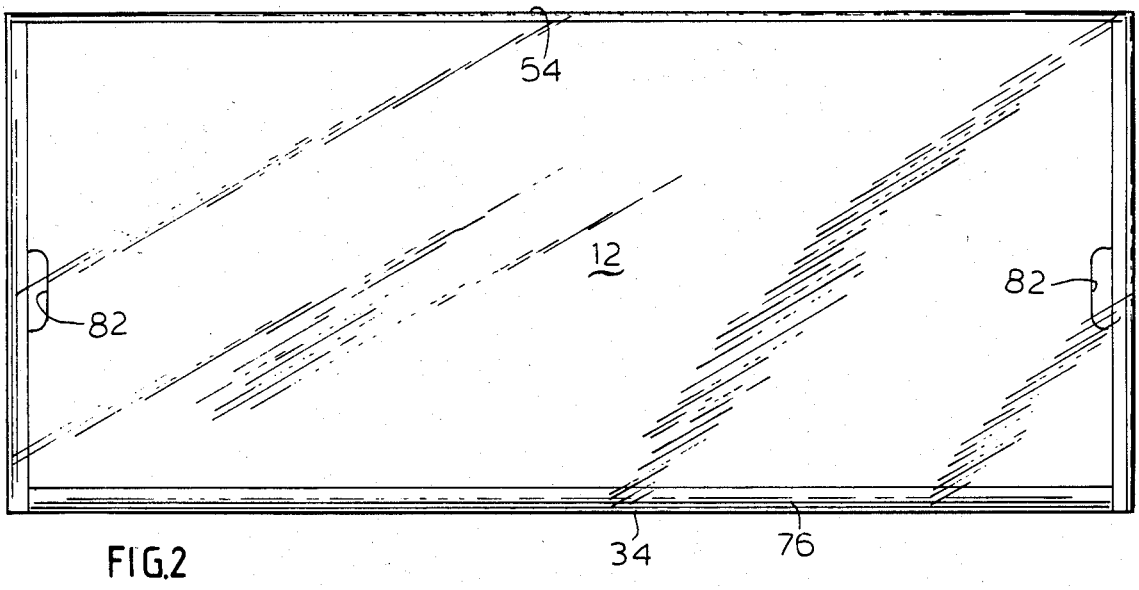
FIG.2
FIG.3
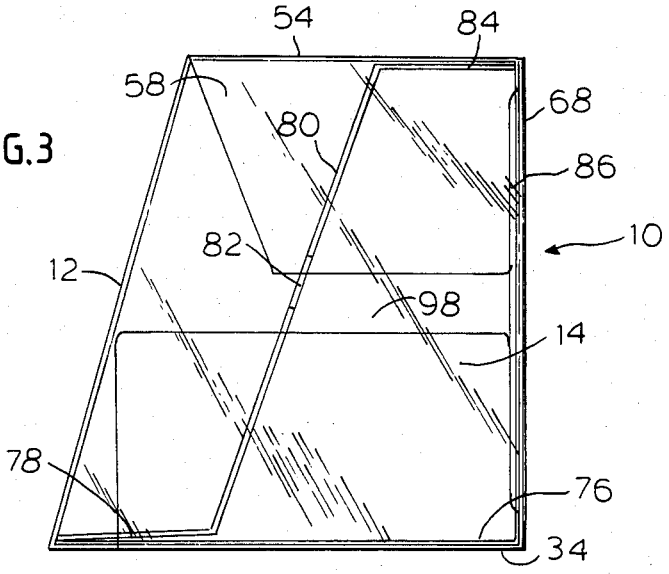
FIG.4
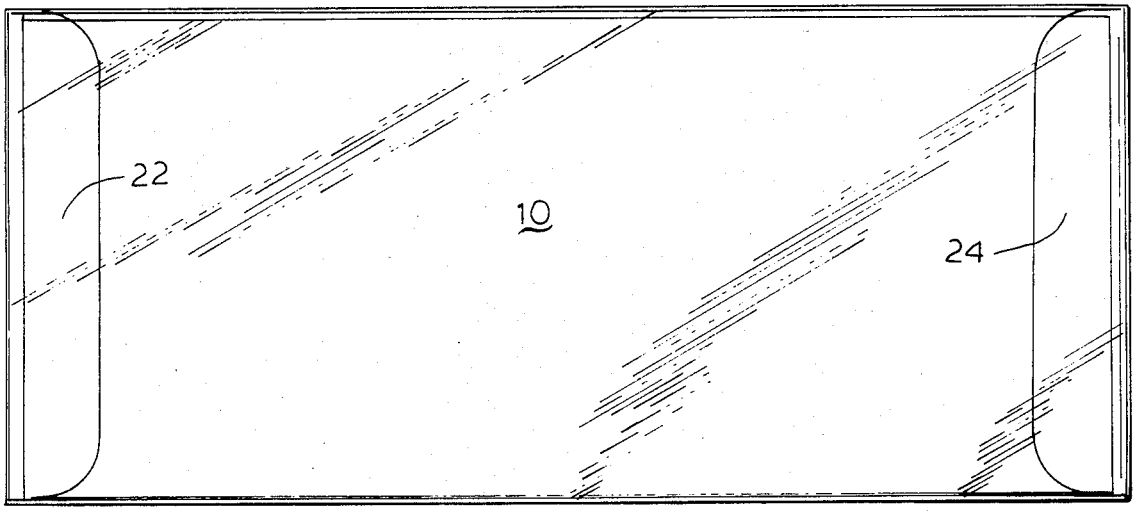

FIG.8
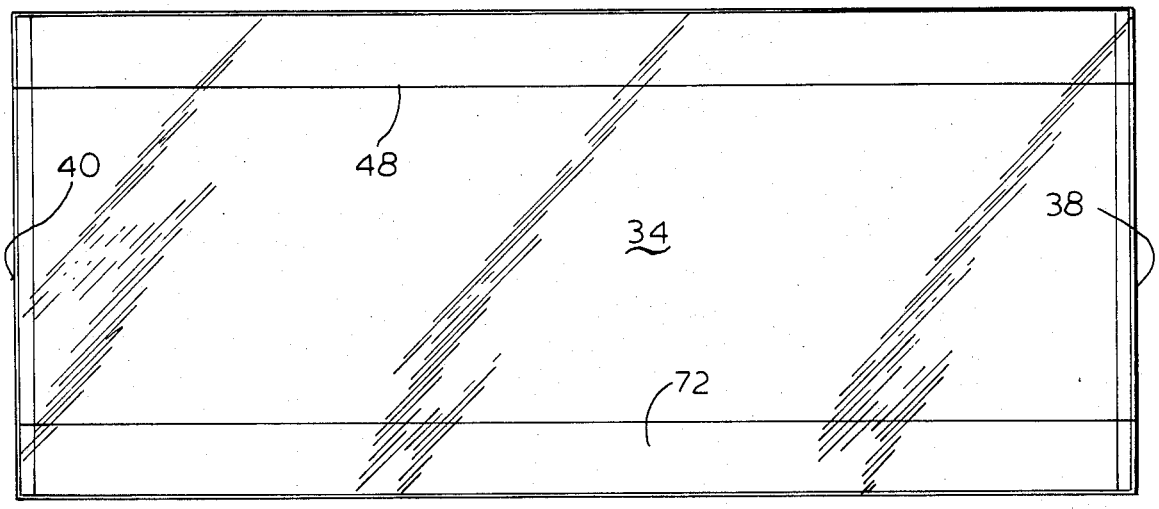
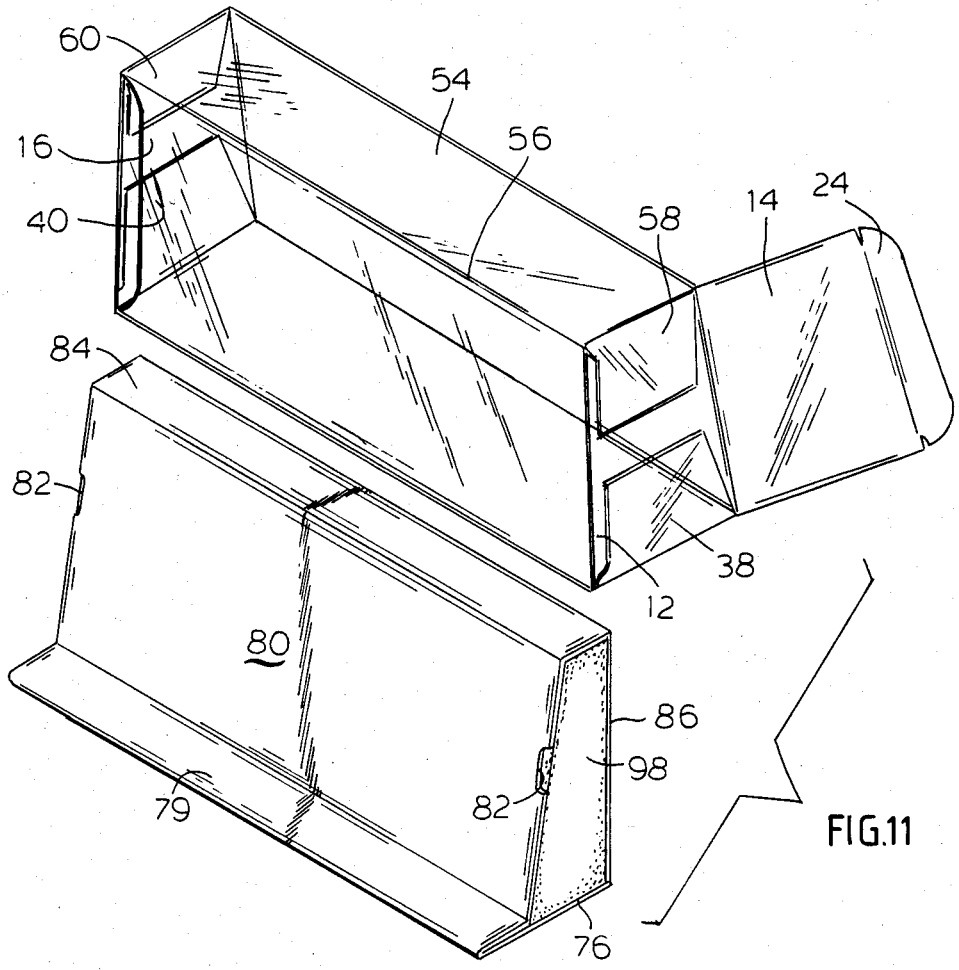
FIG.11

TRANSPARENT RECTANGULAR PACKAGING OF SWIM GOGGLES AND THE LIKE

BACKGROUND OF THE INVENTION

The present invention relates to an improved container, box or case for the packaging and the displaying of various merchandise. In particular, the invention is concerned with an improved transparent package for swim goggles.

Transparent packages are extensively used in many fields. These packages generally are for the purpose to facilitate the showing and the arrangement of merchandise while permitting the buyer to inspect the item packaged and to decide whether to buy it without the aid of a sales person. Already known are presentation packages or display packages of the self-service type which generally consist of a piece of cardborad on which the item is secured and is then covered by cellophane or a transparent plastic in order to protect the displayed item from fading. Another purpose of these containers often is to make it possible to suspend the items to hooks or to string them along.

Many prior art packages of this type completely cover the item packed therein so that the buyer is not able to readily extract the item therefrom and make sure of its quality. Additionally, containers of this type often are designed without allowing for the possibility that the retailers will have to stock them, as their various shapes and dimensions are designed so as to attract the attention of the prospective buyer as much as possible but without sufficient attention being paid to the ease with which they may be stored in a minimum of space.

STATEMENT OF PRIOR PATENT DISCLOSURES

The art to which this invention relates includes U.S. Pat. Nos. 3,955,749; 4,545,482; 4,562,922; and 4,548,323. The first of these patents describes an expansible envelope for shipping items which is formed from a one-piece unitary blank cut and folded into a substantially flat condition. It is not transparent and the envelope does not contain any insert.

In U.S. Pat. No. 4,545,482 is disclosed a U-shaped support pad for various items. This support is not made of plastic and is not intended to fit as an insert in a transparent package.

U.S. Pat. No. 4,562,922 describes a seal end display carton for displaying an article packaged therein which includes a header card comprising a pair of header card panels disposed in face to face arrangement with a bottom wall hinged to cne of the panels. The article to be displayed is positioned between the pair of header card panels.

U.S. Pat. No. 4,548,323 shows a mailing container which has a pair of trapezoidal bottom panels foldably connected along a bottom medial score line and having end edges converging inwardly toward the bottom medial score line, as well as diamond-shaped end wall assemblies at each end of the container, each end wall assembly comprising a pair of triangular end wall panels with each of the triangular end wall panels being foldably connected to one of the inwardly converging end edges of the bottom panels together with a top cover assemblage and a pair of trapezoidal top cover flaps each foldably connected to one of the bottom panels.

This package does not contain an insert therein and is not made of plastic.

As will be seen hereinafter, none of these disclosures hint or suggest in any manner whatsoever applicant's novel, unique and unobvious display package for goggles and the like.

OBJECTS AND SUMMARY OF THE INVENTION

In view of the above, it is an important object of the present invention to provide an improved transparent display package for swim goggles and the like. A further object is to provide unitary integral blanks from which the components constituting the package may be produced.

The above and other beneficial objects, features and advantages of the invention are obtained by providing a transparent package made of flexible but semi-rigid plastic in which is positioned a support insert having a formed plastic backing and against which the goggles and the like are secured.

BRIEF DESCRIPTION OF THE DRAWINGS

FIG. 2 is a rear elevational view of the package;

FIG. 3 is a side elevation of the package taken from the right extremity thereof.

FIG. 4 is a bottom view of the same;

FIG. 8 is a bottom view of the package according to the invention;

FIG. 11 is a perspective view showing assembly of the support in the package according to the invention.

DETAILED DESCRIPTION OF BEST MODE OF THE INVENTION

Figure 1:
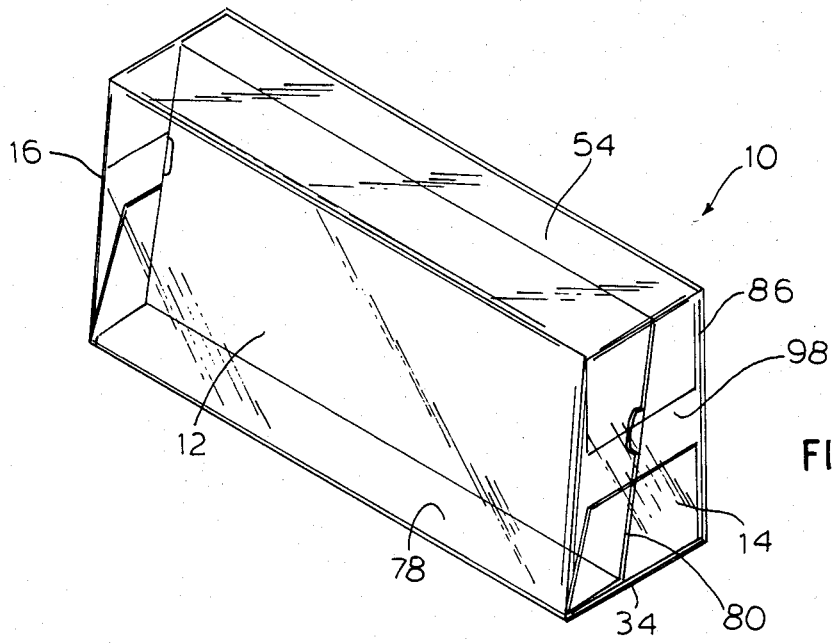
FIG. 1 is a perspective view of a transparent package in accordance with the present invention shown in closed condition.

Referring descriptively to the drawing wherein similar components bear the same reference numerals throughout the several views, the present package 10 is formed, as will be described hereinafter, from any commercially available transparent plastic material such as polyethylene, polycarbonate, polymethacrylate and the like. Preferably, the plastic is about one-half of a millimeter thick so as to provide a certain rigidity and resiliency to the formed package. As shown, the package 10 has the shape of a trapezoid with a back panel perpendicular to its larger base and a front panel which converges inwardly toward the smaller upper base of the trapezoid.

Figure 6:
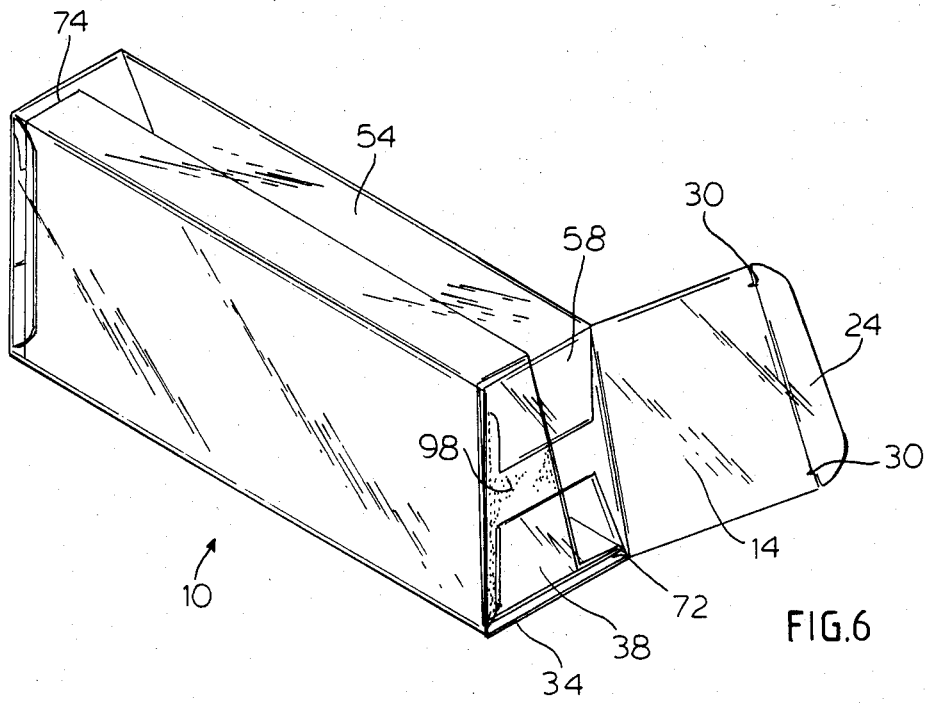
FIG. 6 is a perspective view of the package according to the invention shown with one end flap open.
Figure 5:
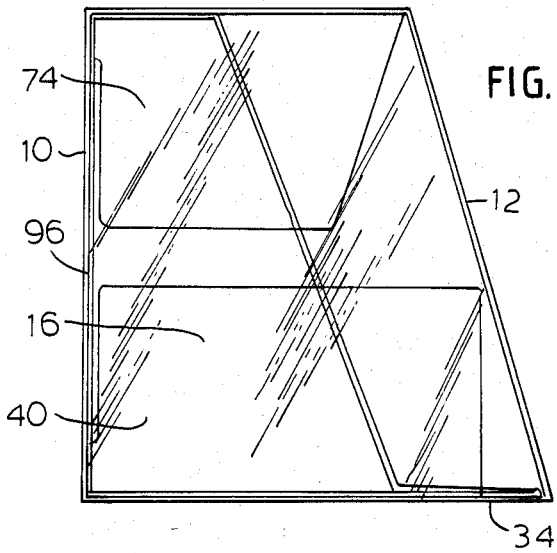
FIG. 5 is a side elevation of the package taken from its left hand extremity.
Figure 7:
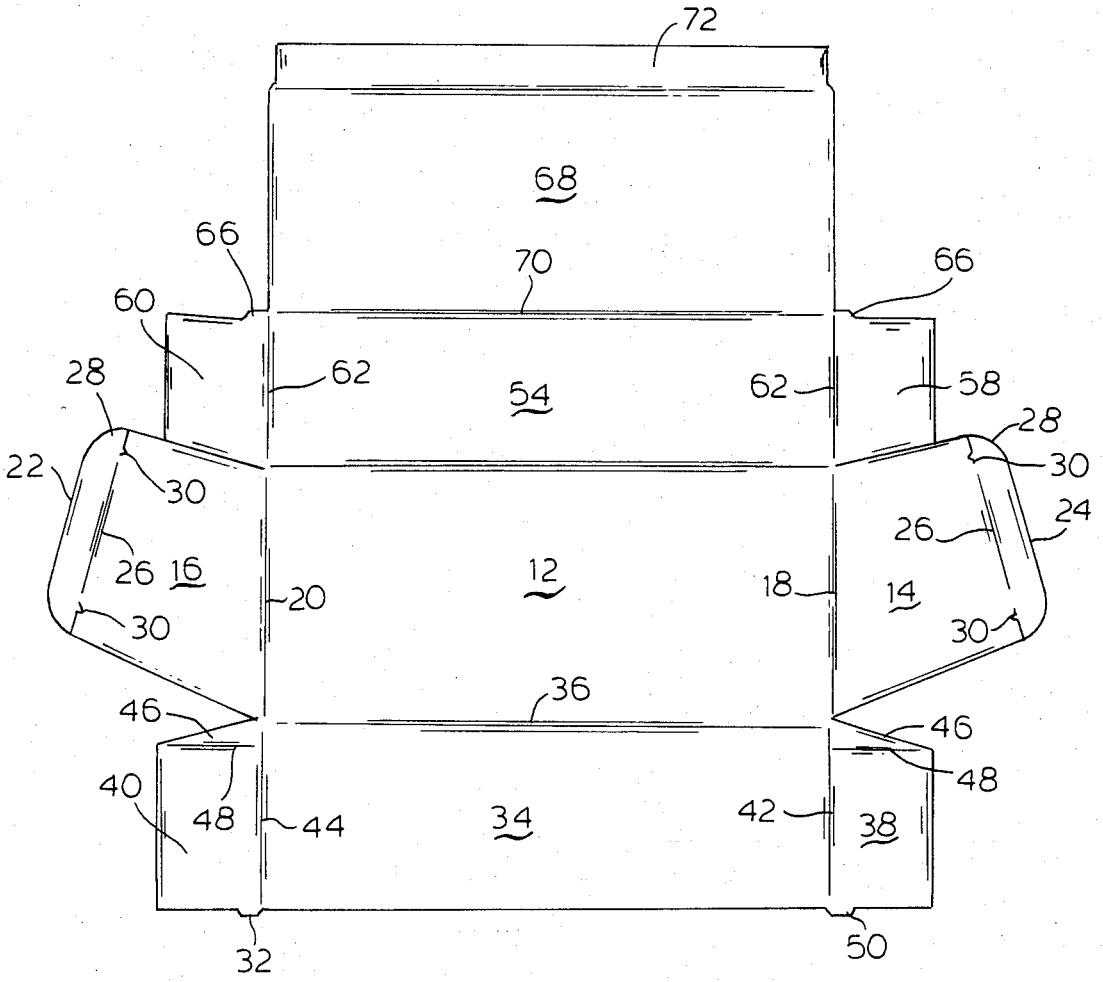
FIG. 7 is a plan view of a one-piece blank for forming the present package.

The plastic blank for forming the package is shown in detail in FIG. 7. As shown, the blank comprises a generally rectangular front panel 12 integrally associated at each end with generally trapezoidally-shaped end panels 14 and 16 which are defined by fold lines which interconnect the front panel 12 with the side panels 14 and 16. Accordingly, right-side panel 14 is connected to front panel 12 along fold line 18. Similarly, left-side panel 16 is connected to front panel 12 by fold line 20. The side panels 16 and 14 terminate in tabs 22 and 24 which are foldably connected to the side panels by score lines 26 and 28. Side securing means are provided between the end panels and the tabs in the form of cuts 28 made therebetween and forming notches 30. These cuts are made by cutting into the side panels 16 and 14 above their respective fold lines 26 and 28 on a straight line for about one centimeter and then cutting downwardly for about a quarter of a centimeter to form the notches. Front panel 12 is foldably connected to base panel 34 along fold line 36. This is the larger base of the package on which the same rests. Base panel 34 terminates on each end in tabs 38 and 40 which are foldably connected thereto by fold lines 42 and 44. Preferably, one side of the tabs is in the form of a triangle, 46, and is foldably connected to the rest of the tab along fold lines 48. The opposite side of tabs 38 and 40 are formed with shoulders 50 and 52, which engage in cuts 28 to lock side panels 14 and 16 over tabs 38, 40, 58 and 60 after these tabs are folded against the vertical extremities of package 10, as shown in FIGS. 5 and 6. Front panel 12 is also integrally associated with top base panel 54 along fold lines 56. At each end, panel 54 terminates in side or vertical tabs 58 and 60 connected therewith along fold lines 62. Each tab 58 and 60 is formed with a shoulder 66 in its upper end near the fold lines. Top base panel 54 is foldably connected to the rear wall 68 of the package along fold line 70. As shown in FIG. 7, back wall 68 is rectangular in shape and has an elongated terminal portion 72 which serves as an adhesive zone which is secured by means of a suitable cement or adhesive to the upper part of the base panel 34 as shown in greater detail in FIGS. 6 and 8. FIGS. 6, 9, 10 and 11 shown in detail the support which fits into the package according to the invention. For best results, it is important that this support 74 be made of a material which is softer, less rigid and substantially less transparent (preferably opaque) than the materials from which package 10 is formed. Thus, this support should be made of paperboard, cardboard and the like which can be fitted snuggly in the package 10 so as to make removal of same by sliding fairly difficult.

Figure 9:
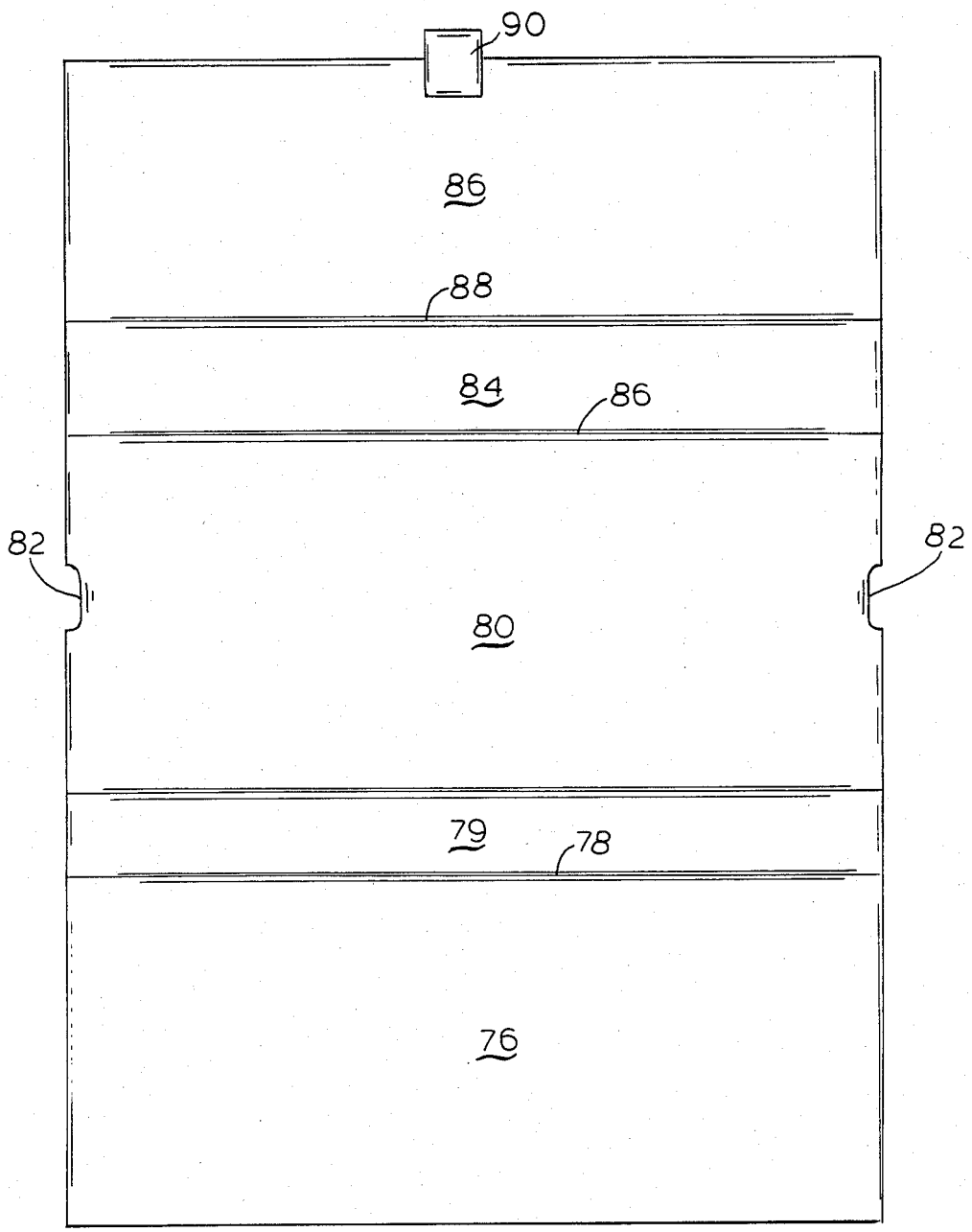
FIG. 9 is a plan view of a blank for forming the article support fitting in the package according to the invention.

As shown in FIG. 9, a blank for making support 74 comprises a generally rectangular piece of cardboard or paperboard which includes a base 76 which is inwardly and foldably connected to a projecting panel 76 along fold line 78 on which may be written advertising or other indicia 79. Panel 78 is also foldably associated with front panel 80. As shown, front panel 80 has at each vertical end thereof a slot 82 which is of a length such as to allow passage therein of straps or other ribbon means normally attached to the ends of goggles for the purpose of securing the same on the wearer thereof. At its upper end, panel 80 is foldably connected to a top panel 84 along fold lines 86. Top panel 84 can have printed thereon various advertising or identifying indicia 79. Panel 84 is foldably connected at its other horizontal end with back panel 86 along horizontal fold line 88. A horizontal free end of panel 86 is secured to the horizontal free end of base panel 76 by means of an adhesive strip 90 or the like, after inserting support 74 in package 10 and tieing the goggles to the support member. As is evident from the drawing, the support member 74 is also lower base 76.

Figure 10:
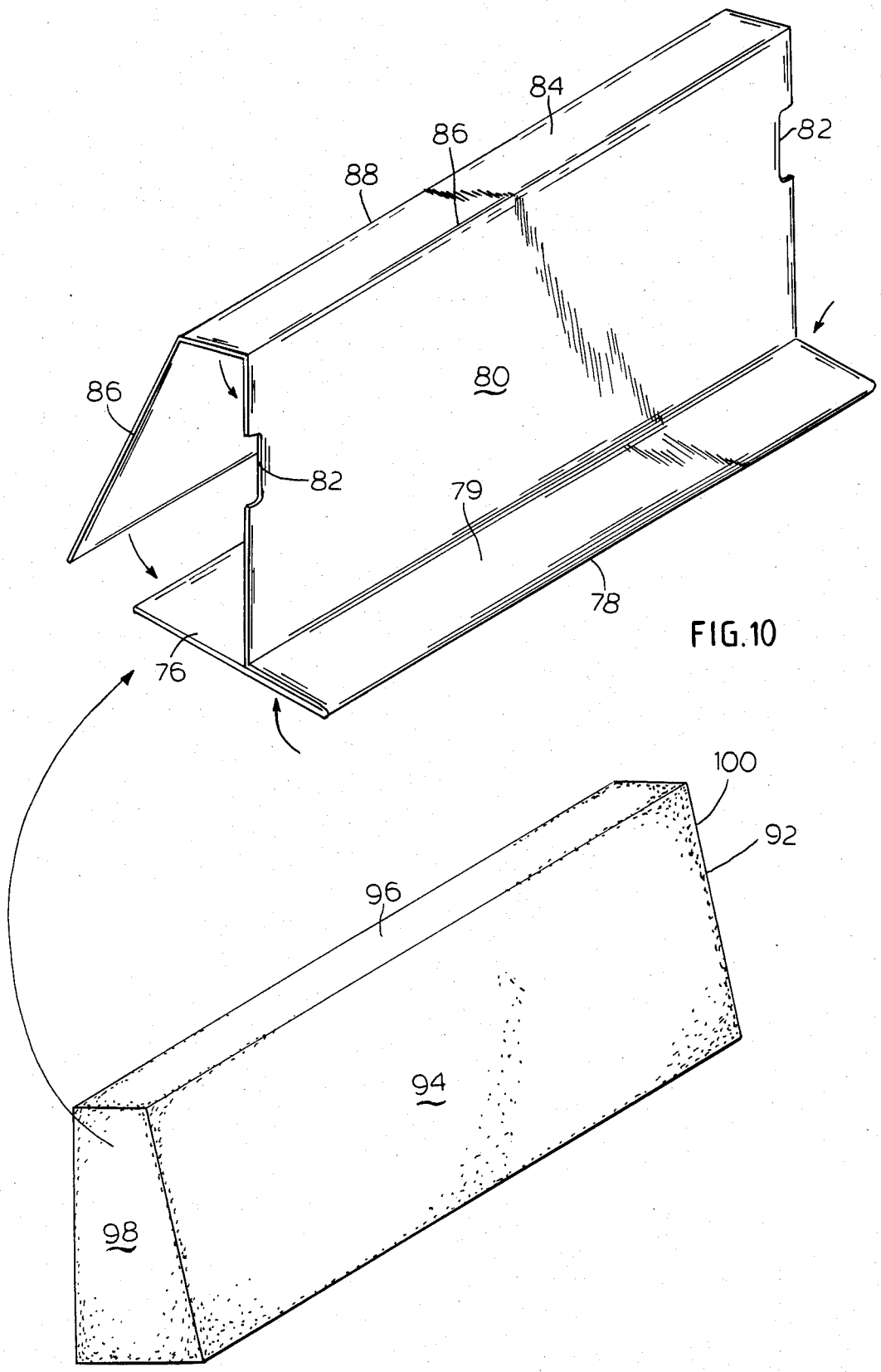
FIG. 10 is a perspective view showing assembly of the plastic backing in the support shown in FIG. 9.

As shown in detail in FIG. 10, a foam plastic backing member 92 such as polystryene or foamed polyethylene or the like, also trapezoidal in shape, is contained in the support member 74. This backing member 92 serves to impart rigidity to the support member 74. As shown in FIG. 10, backing member 92 includes a larger base 94, a top or smaller base 96 and side members 98 and 100. FIG. 10 shows how the backing member 92 is inserted in support member 74 between the front panel 80, the back panel 86, the top panel 84 and the larger base 76 of support member 74. After insertion, back panel 86 is closed against bottom panel 76 by means of adhesive 90 or by any other suitable means. Since insert member 74 is surrounded by the goggles and by their straps and fits in package 10, it is possible to dispense with the strip 90, if desired. At this point in the fabrication of the package of the invention, support 74 has the appearance as shown in FIG. 11. To finish assembly of the package, support member 74 is slidably inserted in package 10 by opening panel 14, lifting panels 38 and 58 which are displaced away from the package, and support 74 is slidably inserted in the package.

For best results, it is preferred that the width of base 76 of insert 74 be substantially equal to that of base 54 of the package. The reason for this advantageously is to make it as difficult as possible to slide the support on which the goggles are mounted from the package and pilfer the goggles thereon.

Another advantageous feature of the invention is that by using plastic material of the thickness and rigidity as indicated, one obtains a certain crackling noise when the panels, such as panels 14 or 16, are open. This signals to the merchant that someone is tampering with a package. It will be noted that the trapezoidal shape of the present package is designed to give better visibility of the article packed therein and furthermore cuts down on glare from light incideht thereon. However, it would be understood that the package may be formed in other shapes, such as rectangular or cylindrical within the scope of this invention.

The package of the invention has been thoroughly tested under actual use conditions as an article 18 cm long, 10 mm high with a base 7.7 cm wide and a top cover or base 5.5 cm wide and has been found to be completely successful of the accomplishment of the above stated objects of the present invention. In the above, only one embodiment of the present invention has been described. It should be understood, however, that the present invention is not limited to the single embodiment shown and described but rather by the scope of the following claims.

What is claimed is:

1. A display package for goggles and the like comprising:

a transparent outer container formed by a one-piece unitary blank cut of plastic and folded into a substantially trapezoidal condition;

a support member snuggly and slidably fitting in said container and formed from one-piece unitary blank of material softer than said container and folded into a substantially trapezoidal condition, said support member independent from said transparent outer container and said support member capable of receiving print and said support member for keeping said goggles in a fixed position against said support member;

a substantially trapezoidal foam plastic backing member contained in said support member; and means on the vertical right-side edge and left-side edge of said support member for receiving the straps of said goggles and the like and securing them to said support member.

2. The package according to claim 1, wherein said container consists of transparent polyethylene, polystyrene, or polycarbonate plastic.

3. The package according to claim 1, wherein said insert consists of paperboard or cardboard.

4. The package according to claim 1, wherein said backing member consists of foamed polystryrene, polyethylene, or polyvinyl chloride.

5. The invention of claim 1 in which said blank comprises:

a front panel, a pair of substantially trapezoidal side wall panels connected to the sides of said front panel along fold lines, end wall panels, said end wall panels being foldably connected at their outer ends thereof to tabs along a fold line; said fold lines being defined between cuts made at the outer ends of said side wall panels and including a notch therein;

a base panel foldably connected lengthwise along the bottom of said front panel, said base panel terminating at each end and end tabs foldably connected thereto along fold lines;

a top base panel foldably connected to the upper end of said front panel and having a surface area less than said base panel so as to give a trapezoidal shape to said blank when the same is assembled, said top panel having at the other ends thereof end tabs foldably connected therewith along fold lines;

a back panel; said panel being foldably connected to said base panel, said back panel including a free outer end foldably connected thereto and serving as an adhesive tab to be secured to the top plane of said base panel; said back panel having an area smaller than said front panel and being foldable at a substantially right angle to said base panel and to said cover panel when said blank is assembled to form a container.

6. The invention according to claim 5, wherein said blank is formed of transparent polyethylene, polystyrene, polymethyacrylate or polycarbonate.

7. The invention of claim 1 in which said blank comprises:

a front panel foldably connected lengthwise thereof with a substantially rectangular top base panel; a substantially rectangular base panel foldably connected to said protruding upper base panel along a fold line;

a cover panel having an area less than the area of said base panel and connected along a fold line to said front panel;

a back panel foldably connected along a fold line to said top panel along a lengthwise edge thereof and having an opposite lateral edge of said back panel being adapted to be secured to the upper side of said base panel.

8. The invention according to claim 7, wherein said front panel has at its opposite vertical lateral edges, securing means for attaching the straps or ribbons of goggles and the like to said insert when the same is assembled.

9. The invention according to claim 7, wherein said base, said front panel, said top cover, and said back panel define a trapezoidal hollow space when said back panel is secured to said base panel.

10. The invention of claim 7, wherein same is shaped from a substantially opaque material.

11. The inventin of claim 10, wherein said material is cardboard or paperboard.

12. The package according to claim 1 wherein said transparent outer container is sufficiently rigid to prevent said goggles from being crushed during display.

* * * * *

UNITED STATES PATENT AND TRADEMARK OFFICE

CERTIFICATE OF CORRECTION

PATENT NO. : 4,733,775

DATED : March 29, 1988

INVENTOR(S) : Barry R. Fireman

It is certified that error appears in the above-identified patent and that said Letters Patent is hereby corrected as shown below:

Column 5, line 7, delete "insert" and substitute therefore --support members--.

Signed and Sealed this

Second Day of August, 1988

*Attest:*

DONALD J. QUIGG

*Attesting Officer*

*Commissioner of Patents and Trademarks*